US006705224B2

(12) United States Patent
Kuroda et al.

(10) Patent No.: US 6,705,224 B2
(45) Date of Patent: Mar. 16, 2004

(54) STAMP APPARATUS

(75) Inventors: Hayato Kuroda, Tokyo (JP); Yoshikazu Tanaka, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/162,863

(22) Filed: Jun. 6, 2002

(65) Prior Publication Data

US 2003/0019380 A1 Jan. 30, 2003

(30) Foreign Application Priority Data

Jun. 7, 2001 (JP) ..... 2001/172859

(51) Int. Cl.[7] ..... B41K 37/02; B31F 1/07; B41J 1/60

(52) U.S. Cl. ..... 101/371; 101/22; 101/23; 101/32; 101/72; 101/75; 101/79; 101/94; 101/95; 101/99; 101/110; 101/216; 101/213; 101/361; 101/368; 101/480; 101/93.03; 400/103; 400/56; 400/58

(58) Field of Search ..... 101/371, 216, 101/213, 480, 75, 79, 72, 94, 95, 99, 110, 361, 368, 22, 23, 32, 93.03; 400/55, 103, 56, 58

(56) References Cited

U.S. PATENT DOCUMENTS 4,415,801 A * 11/1983 Franke ..... 346/82
4,459,910 A * 7/1984 Taube ..... 101/18
4,995,315 A * 2/1991 Koper et al. ..... 101/96
5,237,924 A * 8/1993 Fujino et al. ..... 101/484
5,373,784 A * 12/1994 Muraji ..... 101/93.21
6,006,661 A * 12/1999 Tukahara et al. ..... 101/16
6,095,699 A * 8/2000 Baumann et al. ..... 101/76

* cited by examiner

*Primary Examiner*—Stephen R. Funk
*Assistant Examiner*—Marvin P Crenshaw
(74) *Attorney, Agent, or Firm*—Dickstein, Shapiro, Morin & Oshinsky, LLP

(57) ABSTRACT

In a stamp apparatus, a paper-sheet object is conveyed in the arrow direction between a presser roller and an impress hub having a predetermined character/symbol string. Since a cam is rotated in the arrow direction by a rotary solenoid, it makes the presser roller approach the impress hub via a roller and an arm. A separating lever is rotated in the arrow direction by a rotary solenoid from an initial position (position shown in the drawing) to a siding position. When the paper-sheet object is conveyed to between the presser roller and the impress hub, a stamp bonded on the bottom surface of the paper-sheet object is canceled with a post-mark. A presser mechanism suppresses a rebound produced when the presser roller starts to urge the paper-sheet object, and also maintains a predetermined urging pressure of the presser roller relative to the paper-sheet object having a predetermined thickness or less.

8 Claims, 4 Drawing Sheets

STAMP APPARATUS

BACKGROUND OF THE INVENTION

1. Field of the Invention

The present invention relates to a stamp apparatus and, in particular, to an apparatus for impressing a paper-sheet object with a mark continuously from a predetermined position to another predetermined position. The present invention is applicable, for example, to a machine for canceling a stamp bonded on a postal matter with a postmark (automatic flat canceling machine).

2. Description of the Related Art

A conventional stamp apparatus will be described with reference to FIG. 1. The stamp apparatus comprises a presser roller 31, an impress hub 32, a timing disk 33, a proximity switch 34, and a pair of photoelectric sensors 35*a* and 35*b*.

The structure of the stamp apparatus will be described in detail. The presser roller 31, rotatably supported to one end of an L-shaped arm 36, is always rotated clockwise by a motor (not shown). The arm 36 is rotatable about a point of support 36*a* thereof. The other end of the arm 36 is pulled by a coil spring 37. Therefore, the arm 36 rotates counterclockwise, however, more than a predetermined rotational angle in the left direction is limited by a stopper 38. Adjusting the position of the stopper 38 changes the rotational angle of the arm 36 until a vicinity of the other end of the arm 36 abuts the stopper 38. As a result, a clearance (slightly smaller than the thickness of a paper-sheet object 30) is changed between the presser roller 31 and a part of printing types 32*b* (part having a predetermined character/symbol string) of the impress hub 32.

The impress hub 32 can counterclockwise rotate about the center 32*a*, and has the part of printing types 32*b* with a sectorial shape ranging over approximately 180°. The radius of the part of printing types 32*b* is larger than that of the impress hub 32. The sectorial timing disk 33 fixed to the impress hub 32 has a cut-out 33*a* ranging over approximately 90°.

At a predetermined time after an edge of a paper-sheet object 30 being conveyed at a predetermined speed passes through between an emitting sensor 35*a* and a receiving sensor 35*b*, the paper-sheet object 30 enters between the presser roller 31 and the impress hub 32, which are located at an initial position (position shown in FIG. 1). Then, since the presser roller 31 is pushed up by the paper-sheet object 30, the arm 36 rotates clockwise about a supporting point 36*a*. An impress-starting position on the paper-sheet object 30 reaches between the presser roller 31 and the impress hub 32, a motor (not shown) for the impress hub 32 rotates owing to the detection of the paper-sheet object 30 by the pair of sensors 35*a* and 35*b* and to a function of a delay circuit. Therefore, the impress hub 32 is rotated so as to initiate to impress the paper-sheet object 30 with the part of printing types 32*b*. When the impress hub 32 is rotated around in a complete circle and the cut-out 33*a* of the timing disk 33 is detected by the proximity switch 34, the impress hub 32 stops at the initial position. Up to this point, one cycle of impress is completed.

As the surface of the presser roller 31 is made of an elastic material such as rubber, the surface is slightly compressed when being urged by the paper-sheet object 30.

In the conventional stamp apparatus, the urging force of the presser roller 31 to the paper-sheet object 30 is adjusted with the coil spring 37. Therefore, a paper-sheet object 30 having a predetermined thickness or more cannot pass through between the presser roller 31 and the part of printing types 32*b* of the impress hub 32.

SUMMARY OF THE INVENTION

It is an object of the present invention to provide a stamp apparatus, in which even a thick paper-sheet object can pass through between a presser roller and a part of printing types of an impress hub.

According to the present invention, a stamp apparatus is provided, which comprises an impress hub having a predetermined character/symbol string, a presser roller for urging a paper-sheet object to the impress hub, for impressing the predetermined character/symbol string to the paper-sheet object being conveyed between the impress hub and the presser roller, and a presser mechanism, comprising an arm having the presser roller, for suppressing a rebound produced when the presser roller starts to urge the paper-sheet object by rotating the arm so as to urge the presser roller to the paper-sheet object and simultaneously for maintaining a predetermined urging pressure of the presser roller relative to the paper-sheet object having a predetermined thickness at most.

The present invention described above has advantages as follows.

1. A thick paper-sheet object having a predetermined thickness and below can smoothly pass through between the presser roller and the impress hub.
2. A rebound produced when the presser roller starts to urge a paper-sheet object to the impress hub is suppressed so that the paper-sheet object having a predetermined thickness and below can be clearly impressed.
3. As the stamp apparatus may further comprise a separating lever, the separating lever separates a paper-sheet object from the impress hub immediately after completion of impressing the paper-sheet object by the impress hub, so that the needless contact between the paper-sheet object and the impress hub can be avoided.

DESCRIPTION OF THE PREFERRED EMBODIMENTS

Figure 1:
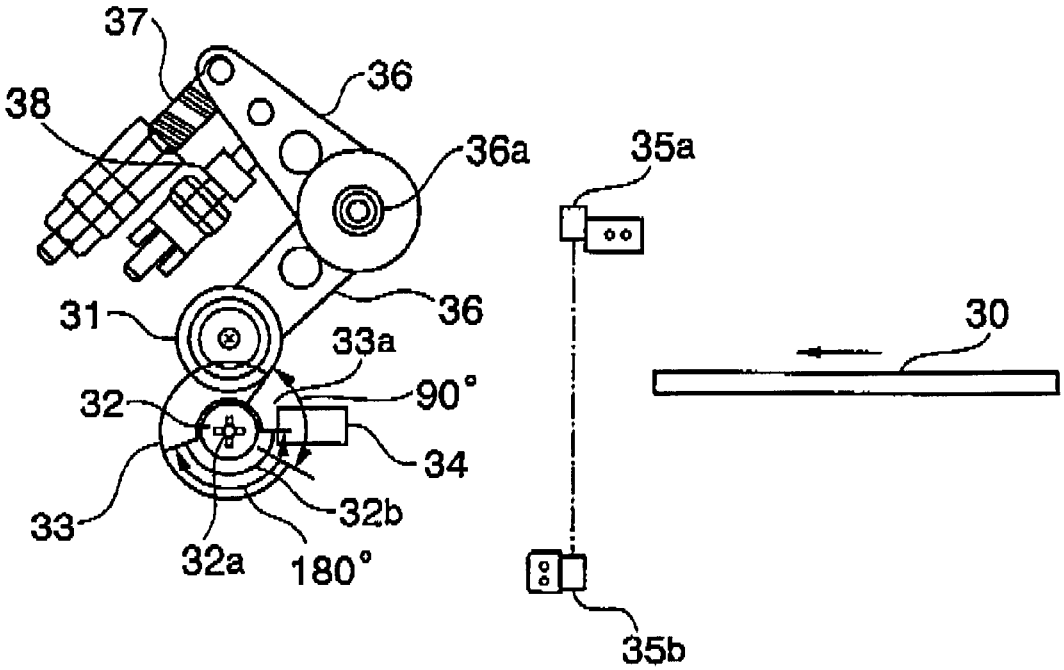
FIG.1 PRIOR ART
FIG. 1 is a front view of a conventional stamp apparatus.

Stamp apparatuses according to two embodiments of the present invention will be described.

First, a first embodiment will be described with reference to FIGS. 2 and 3. In the stamp apparatus, a paper-sheet object 30 is conveyed in the arrow direction between an impress hub 2 and a presser roller 1 which urges the paper-sheet object 30 to the impress hub 2. The impress hub 2 has a part of printing types (part having a predetermined character/symbol string) on the peripheral surface over a range of approximately 250°.

The presser roller 1, having a pulley 1*a* integrally formed on the side face thereof, is rotatably supported at one end 3*a* of a substantially L-shaped arm 3. The arm 3 is rotatable about a shaft 4 as a supporting point, and in a vicinity of the other end of the arm 3, a roller 5 is provided. In the shaft 4, a pulley 6 is rotatably supported, and a rope (i.e., round belt) 7 is wound around and stretched between the pulleys 6 and 1*a*. A rope 9 is also wound around and stretched between the pulley 6 and a motor 8. A cam 10 is rotatably supported to a shaft 11 and is directly connected to a rotary solenoid 12. The cam 10 is pressed into contact with the roller 5. The rotary solenoid 12 outputs a predetermined torque when rotating by a given angle. The profile of the external periphery 10*a* of the cam 10 is formed such that a rate of increase in the angle of rotation of the arm 3 having the presser roller 1 is reduced with increasing angle of rotation of the rotary solenoid 12. By such a configuration, even when the thickness of a paper-sheet object 30 is small, the paper-sheet object 30 can be urged to the impress hub 2 under a proper pushing pressure. Since the arm 3 is being pulled by a coil spring 13, the rotation of the cam 10 in the direction opposite to the arrow is limited by the abutment of one end of the cam 10 to a stopper 14. An initial position of the presser roller 1 (position of the presser roller 1 being most separated from the impress hub 2) is determined by the tensile force of the coil spring 13 and the position of the stopper 14. When the cam 10 excessively rotates in the arrow direction, one end of the cam 10 abuts a shock absorber 15.

In order not to change a conveying speed of a paper-sheet object 30 when the presser roller 1 is urging the paper-sheet object 30 to the impress hub 2, the presser roller 1 is constructed so as to rotate at the same peripheral speed as the conveying speed of the paper-sheet object 30.

Figure 2:
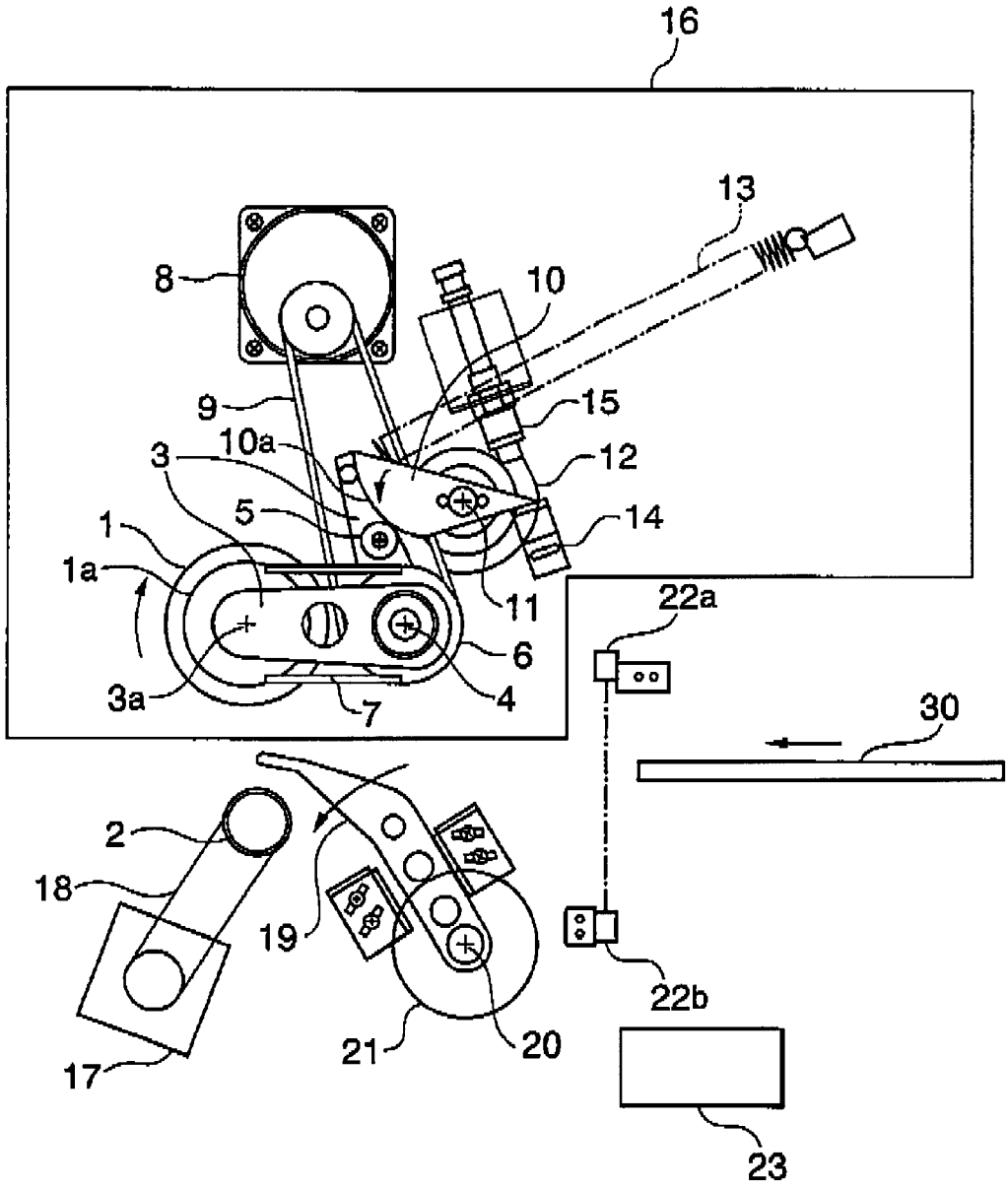
FIG. 2 is a front view of a stamp apparatus according to a first embodiment of the present invention.
Figure 3:
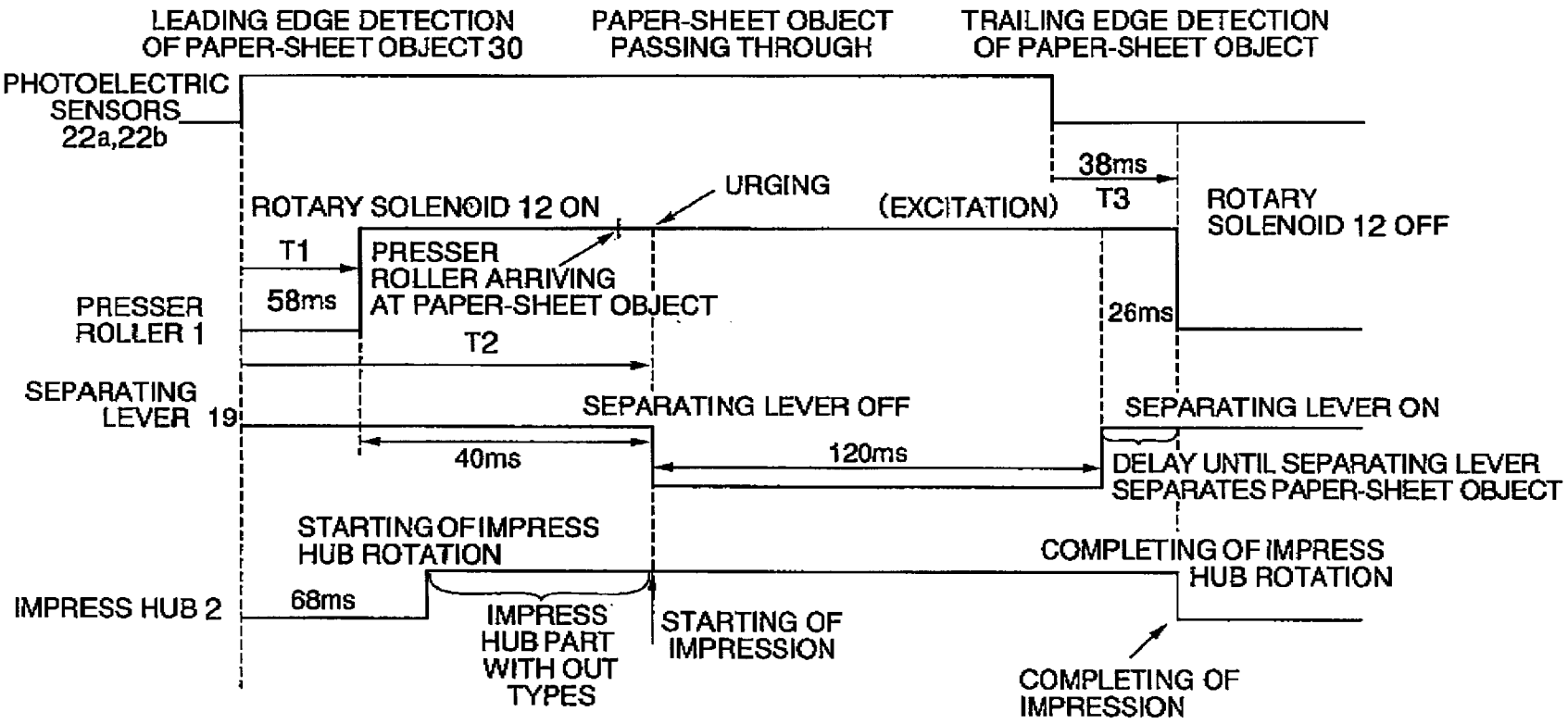
FIG. 3 is a drawing for illustrating the operational timing in the stamp apparatus according to the first embodiment of the present invention.

The segment surrounded by the closing line in FIG. 2 is referred to as a presser mechanism 16.

The impress hub 2 is rotated by a servomotor 17 via a rope 18. A separating lever 19 can be rotated about a shaft 20 by a rotary solenoid 21 in the arrow direction from an initial position (position shown by FIG. 2) to a siding position (position not in touch with a paper-sheet object 30). The rotary solenoid 21 is excited at the initial position.

A pair of emitting and receiving sensors 22*a* and 22*b* detect leading and trailing edges of a paper-sheet object 30 while a control unit 23 performs controls, which will be described later.

When the leading edge of a paper-sheet 30 being conveyed at a predetermined speed in the arrow direction is detected by the pair of photoelectric sensors 22*a* and 22*b*, the control unit 23 cancels the excitation of the rotary solenoid 21 while exciting the rotary solenoid 12. Accordingly, the separating lever 19 rotates from the initial position to the siding position. As the cam 10 also rotates in the arrow direction, it makes the presser roller 1 approach the impress hub 2 via the roller 5 and the arm 3. When the paper-sheet object 30 is conveyed between the impress hub 2 and the presser roller 1, a stamp bonded on the bottom surface of the paper-sheet object 30 is canceled with a postmark. At a predetermined time after the pair of photoelectric sensors 22*a* and 22*b* detect the trailing edge of the paper-sheet object 30, the control unit 23 excites the rotary solenoid 21 while canceling the excitation of the rotary solenoid 12. Accordingly, the separating lever 19 rotates from the siding position to the initial position. At this time, the separating lever 19 separates the paper-sheet object 30 from the impress hub 2. Also, the presser roller 1 is moved from the position close to the impress hub 2 to the initial position by the coil spring 13.

The operational timing of the stamp apparatus according to the first embodiment will be described with reference to FIG. 3.

The pair of photoelectric sensors 22*a* and 22*b* detect the leading edge of a paper-sheet object 30 (thick object with a thickness of one inch and below, for example) being conveyed at a predetermined speed (1.5 m/s, for example) so as to output a leading-edge signal. The control unit 23 excites the rotary solenoid 12 at a predetermined time T1 (58 ms, for example) after receiving the leading-edge signal. Then, the rotary solenoid 12 is excited so that the cam 10 and the arm 3 are rotated so as to move the presser roller 1 from the initial position to the position close to the impress hub 2. At a predetermined time (68 ms, for example) after the control unit 23 receives the leading-edge signal, the impress hub 2 starts to rotate so that the paper-sheet object 30 is conveyed to between the presser roller 1 and the impress hub 2.

At a predetermined time T2 (98 ms, for example) after receiving the leading-edge signal, which is the timing when the impress-starting position of the paper-sheet object 30 arrives at between the presser roller 1 and the impress hub 2 and also when the presser roller 1 urges the paper-sheet object 30 to the impress hub 2 by abutting the paper-sheet object 30, the excitation of the rotary solenoid 21 is canceled. Then, the separating lever 19 is moved from the initial position to the siding position not in touch with the paper-sheet object 30, so that the impress hub 2 starts to impress the paper-sheet object 30 with a mark.

When the rotary solenoid 21 of the separating lever 19 is excited at a predetermined time (218 ms, for example) after the control unit 23 receives the leading edge signal, the separating lever 19 is moved from the siding position toward the initial position so as to start to separate the paper-sheet object 30 from the impress hub 2. The pair of photoelectric sensors 22*a* and 22*b* detect the trailing edge of the paper-sheet object 30 so as to output a trailing edge signal. The control unit 23 stops the rotation of the impress hub 2 at a predetermined time T3 (38 ms, for example) after receiving the trailing edge signal. As for the rotational position of the impress hub 2, the position starting the impressing is configured to be the same as the stopping position when completing the impressing. When canceling the excitation of the rotary solenoid 12, the arm 3 is clockwise rotated about the shaft 4 until one end of the cam 10 abuts the stopper 14 by the tensile force of the coil spring 13. As a result, while the presser roller 1 moves to the initial position, the separating lever 19 separates the paper-sheet object 30 from the impress hub 2 during movement to the initial position.

Next, a second embodiment will be described with reference to FIG. 4. The description of the same parts of the second embodiment as those of the first embodiment is omitted and only different points will be described.

A pulley 24 fixed to the arm 3 is rotatably supported in the shaft 4. The pulley 24 is rotated by a required angle by a servomotor 26 via a rope 25.

Figure 4:
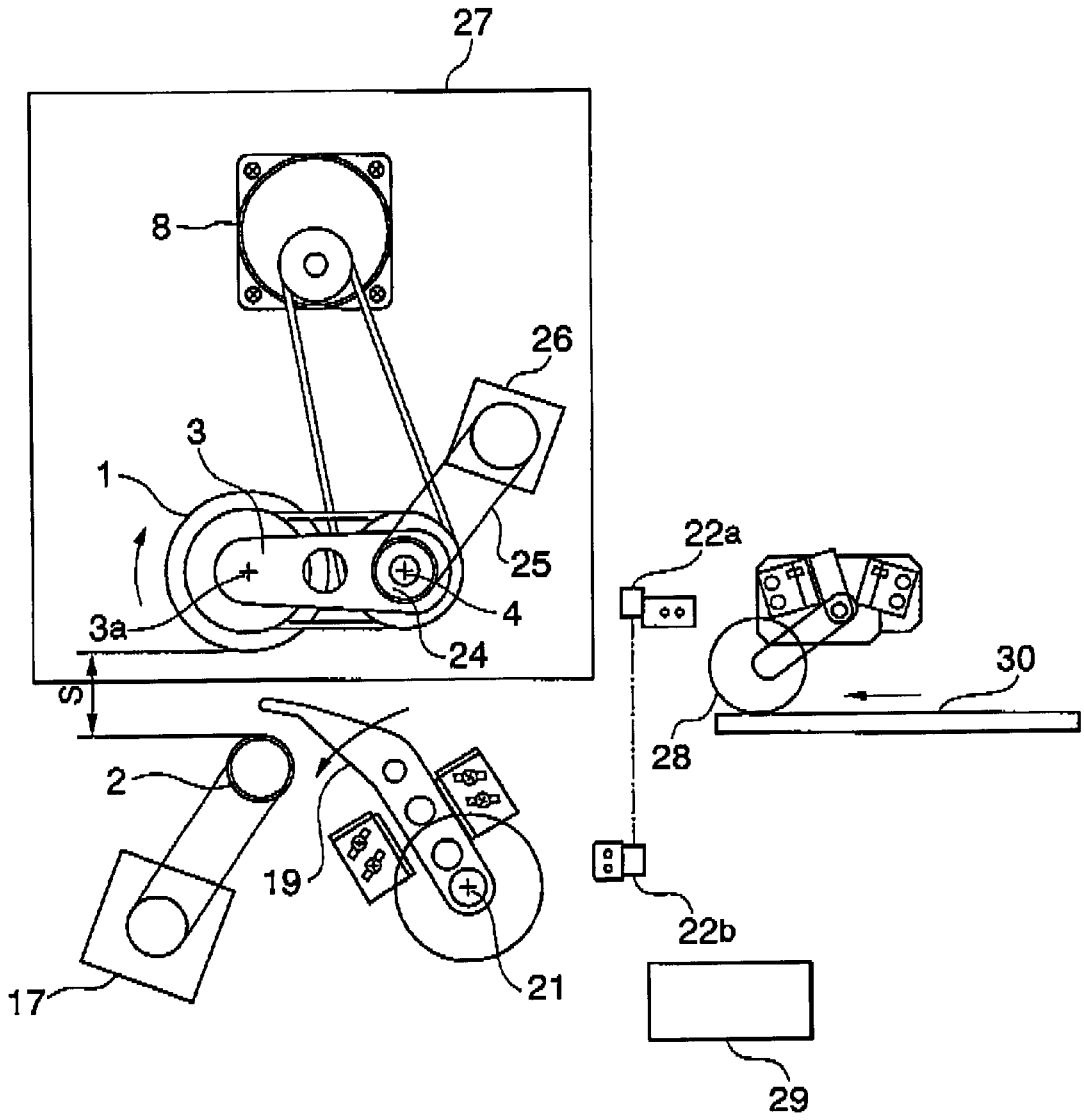
FIG. 4 is a front view of a stamp apparatus according to a second embodiment of the present invention.

The segment surrounded by the closing line in FIG. 4 is referred to as a presser mechanism 27.

By a thickness sensor 28 arranged upstream the pair of photoelectric sensors 22*a* and 22*b*, the thickness S of a paper-sheet object 30 is detected in advance. A control unit 29 controls the rotation of the servomotor 26 in accordance with the thickness S of the paper-sheet object 30. The presser roller 1 is movable between a predetermined initial position not in touch with the paper-sheet object 30 and a position spaced by a length S from the impress hub 2. A rebound produced when the presser roller 1 starts to urge the paper-sheet object 30 to the impress hub 2 is suppressed by a torque controlling function of the servomotor 26.

What is claimed is:

1. A stamp apparatus comprising:

an impress hub having a predetermined character/symbol string;

a presser roller for urging a paper-sheet object to the impress hub, for impressing the predetermined character/symbol string to the paper-sheet object being conveyed between the impress hub and the presser roller; and a presser mechanism, comprising an arm having the presser roller, for suppressing a rebound produced when the presser roller starts to urge the paper-sheet object by rotating the arm with a predetermined torque so as to urge the presser roller to the paper-sheet object and simultaneously for maintaining a predetermined urging pressure of the presser roller relative to the paper-sheet object having a predetermined thickness.

2. A stamp apparatus according to claim 1, wherein the presser mechanism further comprises a servomotor for rotating the arm about a predetermined point in the arm and also for suppressing the rebound produced when the presser roller starts to urge the paper-sheet object so as to maintain the predetermined urging pressure of the presser roller.

3. A stamp apparatus according to claim 1, wherein the presser roller is configured to rotate at the same peripheral speed as a conveying speed of the paper-sheet object.

4. A stamp apparatus comprising:

an impress hub having a character/symbol string;

a presser roller for urging a paper-sheet object to the impress hub, for impressing the predetermined character/symbol string to the paper-sheet object being conveyed between the impress hub and the presser roller; and a presser mechanism, comprising an arm having the presser roller, for suppressing a rebound produced when the presser roller starts to urge the paper-sheet object by rotating the arm so as to urge the presser roller to the paper-sheet object and simultaneously for maintaining a predetermined urging pressure of the presser roller relative to the paper-sheet object having a predetermined thickness, wherein the presser mechanism comprises:

a roller provided in the arm;

a cam for rotating the arm about a predetermined point on the arm by pushing the roller while rotating and also for suppressing the rebound produced when the presser roller starts to urge the paper-sheet object; and a solenoid for rotating the cam so as to maintain the predetermined urging pressure of the presser roller.

5. A stamp apparatus according to claim 4, wherein the solenoid is a rotary solenoid for outputting a predetermined torque when rotating at a given angle.

6. A stamp apparatus according to claim 5, wherein an external peripheral profile of the cam is formed such that a rate of increase in an angle of rotation of the arm having the presser roller is reduced with an increasing angle of rotation of the rotary solenoid.

7. A stamp apparatus comprising:

an impress hub having a predetermined character/symbol string;

a presser roller for urging a paper-sheet object to the impress hub, for impressing the predetermined character/symbol string to the paper-sheet object being conveyed between the impress hub and the presser roller; and a presser mechanism, comprising an arm having the presser roller, for suppressing a rebound produced when the presser roller starts to urge the paper-sheet object by rotating the arm so as to urge the presser roller to the paper-sheet object and simultaneously for maintaining a predetermined urging pressure of the presser roller relative to the paper-sheet object having a predetermined thickness; and a separating lever that separates the paper-sheet object from the impress hub upon completion of impressing the paper-sheet object by the impress hub.

8. A stamp apparatus according to claim 7, further comprising:

a photoelectric sensor for detecting a leading edge of the paper-sheet object and outputting a leading edge signal and for detecting a trailing edge of the paper-sheet object and outputting a trailing edge signal; and a control unit capable of:

starting the arm to rotate so as to move the presser roller from an initial position of the presser roller toward the impress hub at a predetermined time T1 after receiving the leading edge signal from the photoelectric sensor;

moving the separating lever from an initial position of the separating lever to a sliding position where the separating lever is not in touch with the paper-sheet object and simultaneously starting the impress hub impressing the paper-sheet object at a predetermined time T2 after receiving the leading-edge signal, which is the timing when the paper-sheet object conveyed between the presser roller and the impress hub arrives at an impress-starting position and is also when the presser roller urges the paper-sheet object to the impress hub by moving toward the impress hub to abut the paper-sheet object; and making the impress hub terminate impressing the paper-sheet object, moving the presser roller to the initial position of the presser roller by stopping the rotation of the arm, and separating the paper-sheet object from the impress hub by moving the separating lever from the siding position of the separating lever to the initial position, at a predetermined time T3 after receiving the trailing edge signal from the photoelectric sensor.

* * * * *